United States Patent [19]

Garber

[11] 4,010,860

[45] Mar. 8, 1977

[54] SHAPED CONTAINER

[76] Inventor: Bernard Garber, 6963 N. Bell, No. 108, Chicago, Ill. 60645

[22] Filed: Nov. 3, 1975

[21] Appl. No.: 628,416

[52] U.S. Cl. ..... 215/1 R; 220/70; 215/329

[51] Int. Cl.[2] ..... B65D 23/00

[58] Field of Search ..... 215/1 R, 10, 329, 352; 222/143; 220/70

[56] References Cited

UNITED STATES PATENTS

| | | | |
|---|---|---|---|
| 1,832,806 | 11/1931 | Dawson | 215/1 R |
| 1,891,361 | 12/1932 | Stanley | 215/329 |
| 1,898,342 | 2/1933 | Cuthbert | 215/329 |
| 3,156,272 | 11/1964 | Indrunas | 215/10 X |
| 3,266,533 | 8/1966 | McHale | 215/10 X |
| 3,402,844 | 9/1968 | Chin | 215/329 |

*Primary Examiner*—Ro E. Hart
*Attorney, Agent, or Firm*—Hill, Gross, Simpson, Van Santen, Steadman, Chiara & Simpson

[57] ABSTRACT

A generally cylindrical container is symmetrical both axially and radially and has an opening at opposite longitudinal ends for dispensing its contents. The interior of the container is tapered at either end into pouring spouts, while the exterior is tapered slightly inwardly toward the middle of the container for easier grasping and has broad end sections for stable standing and stacking on end. Increased wall thickness at either end weights the container to increase stability in an upright position. End caps screw onto the container over the end openings thereof, sealing against leakage.

6 Claims, 4 Drawing Figures

Fig. 1
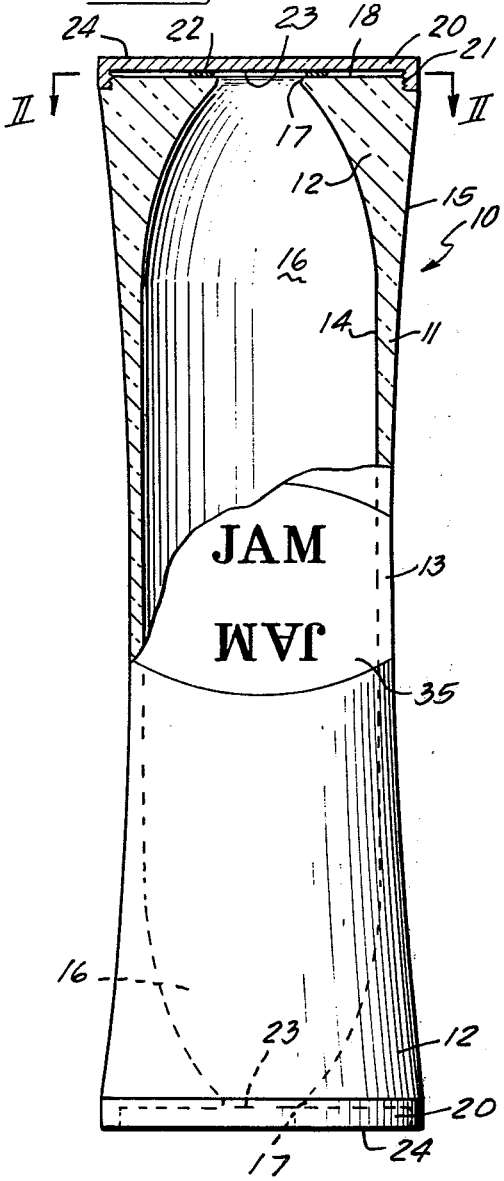
Fig. 2
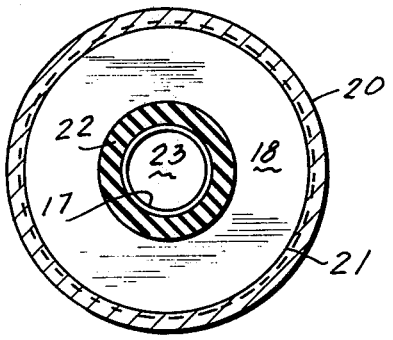
Fig. 3
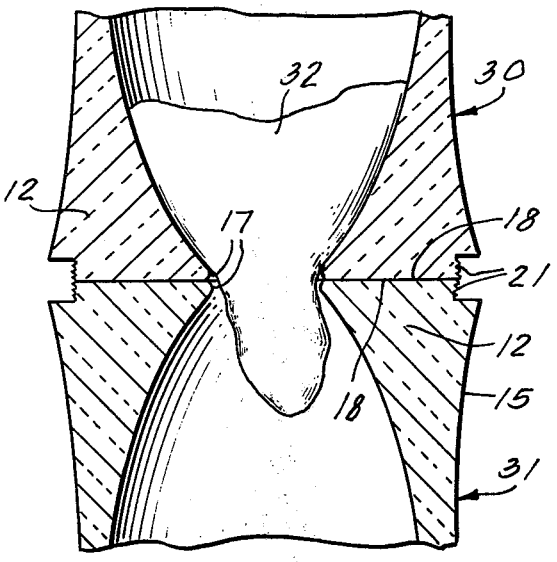
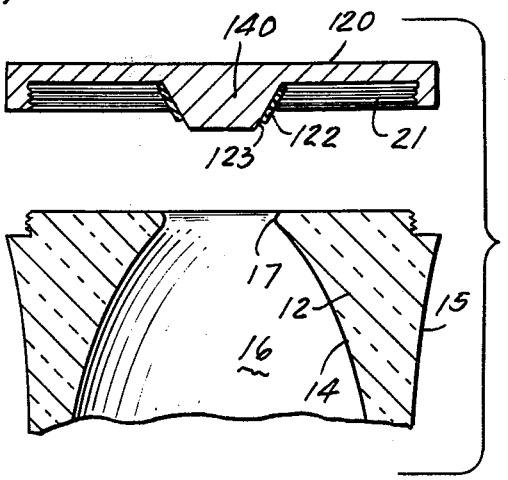
Fig. 4

SHAPED CONTAINER

BACKGROUND OF THE INVENTION

1. Field of the Invention

The present invention relates to improvements in containers such as bottles with sealable openings.

2. The Prior Art

It is known generally to provide bottles or containers for liquids, including liquid and semi-liquid or viscous foods such as jellies, honey, catsup, and salad dressings, in shapes designed for convenient storage and for dispensing of contents by scooping or pouring through a sealable opening. Generally such containers have a single opening at one end, the opposite end being closed by a base portion formed integrally with the walls of the container. U.S. Pat. No. 1,635,070 shows a bottle having both upper and lower openings, each of which is sealable by a cap. Only the top cap is said to be removed to dispense the contents, but for cleaning the bottle prior to reuse, a lower crown cap is removed also for passage of cleaning fluid directly through the bottle, in one end and out the other. The crown cap shown is not replaceable by a consumer, so the container is not readily reuseable. U.S. Pat. No. 2,611,499 shows containers having openings for dispensing of contents from either end, but having a median wall dividing the interior into two separate spaces in which different fluids may be stored.

SUMMARY OF THE INVENTION

It is an object of the invention to provide a container which facilitates the conservation of food and other contents placed within the container by allowing access to such contents from either end of the container. It is also within the scope of the present invention to provide a double ended container which is shipable and stackable with either end up and is stable when stood and stacked on either end with or without an end cap thereon.

In accordance with the present invention, a generally cylindrical container is provided which is both longitudinally and radially symmetrical and has an opening at either end which is sealable by a replaceable screw cap. The side wall of the container is thick at its ends and thin toward the middle of the container, providing a tapered interior space with a pouring spout at either end; the outer shape of the container is broad at the ends and concave toward the center for easy grasping. The end caps have flat outer surfaces to permit the container to stand on either of its ends and to permit several such containers to be stacked one atop another.

BRIEF DESCRIPTION OF THE DRAWINGS

FIG. 1 shows a side view, partially in section, of the container.

FIG. 2 is a cross-sectional, axial view on line II—II in FIG. 1.

FIG. 3 is a partial cross-sectional view through two stacked containers of the present invention.

FIG. 4 shows an alternative embodiment of the cap of the present invention, from the side and in section.

DESCRIPTION OF THE PREFERRED EMBODIMENTS

A shaped container in accordance with the present invention is shown at 10 in FIG. 1, comprising a generally cylindrical side wall 11 having end portions 12 and a central portion 13 and also having interior and exterior surfaces 14 and 15, respectively. The exterior surface 15 of the container 10 is wider or has a greater diameter at the ends 12 than at the center 13, permitting easy grasp about the middle of the container for for manipulation thereof. The interior surface 14 of the container 10 is generally cylindrical through the center portion 13 but is tapered toward each end to form each weighted end 12 and also to form a pouring spout portion 16. The surface 14 terminates in lips 17,17 to form openings in flat end walls 18,18 of the container.

Each opening in each end wall 18 is covered or sealed by a closure member or end cap 20 which is received by means of screw threads 21 formed in the outer surface 15 of the container 10 adjoining the end walls 18. It will be understood that other mating connection means such as a male and female bayonet coupling could also be provided as a selective alternative. A gasket material 22 is bonded to an inner surface 23 of the end cap 20 to form a liquid-tight seal about the lip 17 in cooperation with the wall 18 to prevent escape of the contents and circulation of air thereto. An outer surface of each end cap 20 is substantially flat and is as broad as the diameter of the outer surface 15 of the container 10 to provide an extended, stable surface 24 for standing the container 10 on a shelf or table or other surface as well as to permit stacking of one container upon another in storage.

The structure of the present invention facilitates complete emptying of a container to a plate or other use area by removal of both end caps. Convenient consolidation of foods or other contents from a nearly-empty bottle or container 30 to a full or nearly-full container 31, as shown in FIG. 3. End caps 20 are removed from the top of the container 31 and the bottom of the container 30, and the openings outlined by the lips 17 in the respective containers placed in register. The flat axial end surfaces 18,18 on the ends of the containers 30,31 provide a broad, stable surface for resting container 30 upon the other container 31 during the consolidation operation. Since fluid contents 32 useable with the containers 30 and 31 is preferably somewhat slow-flowing, such as salad dressing, honey, catsup, oil, and the like, the container 30 may be placed upon the container 31 with little or no loss of contents. Over a period of time the contents 32 will flow from the container 30 into the container 31 with little or no residue left in the container 30.

An alternate form of the closure member is depicted in FIG. 4. In this embodiment, end cap 120 has a centrally-disposed, tapered plug portion 140 which carries a gasket material 122 on a conical surface 123 thereof. The gasket material 122 engages the lip 17 of the pouring spout 16 and the end wall 18 to form a liquid-tight seal thereabout.

Because the container 10 is symmetrical and double-ended, the containers 10 further may be placed on a shelf as in a retail store with either end up. Thus, it is advantageous to provide a label 35 as shown in FIG. 1 which is readable in either position. Then stocking of retail shelves may be accomplished more expeditiously than if containers must be oriented before being placed thereon.

Although various minor modifications might be suggested by those versed in the art, it should be understood that I wish to embody within the scope of the patent warranted hereon all such modifications as reasonable and properly come within the scope of my contribution to the art.

I claim as my invention:

1. A generally cylindrical, hollow container having a longitudinal axis and being bilaterally symmetric about a median plane normal to said axis, said container comprising:

a solid circumferential wall forming said container with an outer peripheral surface and a hollow therewithin at an inner peripheral surface thereof, said wall being radially thicker near opposite longitudinal extremities of said container and radially thinner near said median plane, thereby to form a weighted end for promoting support stability, said outer peripheral surface being tapered concavely inwardly toward said median plane from said ends, and said inner peripheral surface tapering to reduced cross-section at each of said ends at openings therein, said wall further having a flat axial surface on each said end about said opening;

engagement means forming a coupling adjacent each said flat surface;

a closure member connected to each respective coupling, each of said closure members having a flat closure surface extending radially across said axial opening forming a support surface by means of which the containers may be positioned uprightly on a support surface; and sealing means between said wall and said closure member engaging said axial wall and said closure member about said opening to form a liquid-tight seal.

2. A container as defined in claim 1, wherein said sealing means comprises a gasket material affixed to each said closure member.

3. A container as defined in claim 1, wherein each said closure member carries an axially-disposed plug having a side wall tapered toward said median plane of said container, each said plug engaging said wall of said container in said opening.

4. A container as defined in claim 1, wherein said engagement means for engaging said closure member comprises a male screw-threaded portion and said closure member comprises a female screw-threaded member cooperable therewith.

5. A container as defined in claim 1, where said axial end surfaces are flat and parallel to one another, thereby to form a stable base for a pair of containers placed end to end without end caps for contents consolidation.

6. A container as defined in claim 1, wherein each of said closure members has a flat outer surface opposite said sealing means, thereby to form stable bases for said container and for stacking an additional container atop the container for storage thereof.

* * * * *